US008967516B2

(12) United States Patent
Dallimore et al.

(10) Patent No.: US 8,967,516 B2
(45) Date of Patent: Mar. 3, 2015

(54) WEAR TIP HOLDER FOR A VSI CRUSHER, A KIT COMPRISING A WEAR TIP HOLDER, AND A METHOD OF REDUCING THE WEAR RATE OF A WEAR TIP HOLDER

(75) Inventors: Rowan Dallimore, Somerset (GB); Knut Kjaerran, Svedala (SE); Andreas Forsberg, Malmo (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 14/346,333

(22) PCT Filed: Aug. 29, 2012

(86) PCT No.: PCT/EP2012/066753

§ 371 (c)(1),
(2), (4) Date: Mar. 21, 2014

(87) PCT Pub. No.: WO2013/041335

PCT Pub. Date: Mar. 28, 2013

(65) Prior Publication Data

US 2014/0252144 A1 Sep. 11, 2014

(30) Foreign Application Priority Data

Sep. 23, 2011 (EP) ..... 11182571

(51) Int. Cl.
*B02C 19/00* (2006.01)
*B02C 13/28* (2006.01)
*B02C 13/18* (2006.01)

(52) U.S. Cl.
CPC ..... *B02C 13/28* (2013.01); *B02C 13/1842* (2013.01); *B02C 13/2804* (2013.01); *B02C 13/1835* (2013.01)
USPC ..... 241/300; 241/275; 241/294

(58) Field of Classification Search
CPC ..... B02C 13/2804; B02C 13/1842; B02C 13/1814
USPC ..... 241/275, 294, 300
See application file for complete search history.

(56) References Cited

U.S. PATENT DOCUMENTS

| | | | | |
|---|---|---|---|---|
| 3,997,011 | A | 12/1976 | Staroba | |
| 4,819,746 | A | 4/1989 | Brown et al. | |
| 4,896,838 | A * | 1/1990 | Vendelin et al. | 241/275 |
| 4,940,188 | A * | 7/1990 | Rodriguez et al. | 241/275 |
| 5,954,282 | A * | 9/1999 | Britzke et al. | 241/275 |
| 6,382,536 | B1 * | 5/2002 | Lusty et al. | 241/5 |
| 6,405,953 | B1 * | 6/2002 | Warren | 241/275 |
| 7,677,484 | B2 * | 3/2010 | Dallimore et al. | 241/275 |
| 2008/0121746 | A1 * | 5/2008 | Hall et al. | 241/191 |
| 2008/0265075 | A1 * | 10/2008 | Dallimore et al. | 241/300 |

FOREIGN PATENT DOCUMENTS

| | | | |
|---|---|---|---|
| CN | 1890452 | A | 1/2007 |
| CN | 101023240 | A | 8/2007 |
| WO | 2008133568 | A1 | 11/2008 |

* cited by examiner

*Primary Examiner* — Faye Francis
*Assistant Examiner* — Onekki Jolly
(74) *Attorney, Agent, or Firm* — Corinne Gorski

(57) ABSTRACT

A wear tip holder for holding a wear tip adjacent to an outflow opening of a vertical rotor wall of a rotor of a VSI crusher includes a mounting plate for mounting the wear tip holder to the rotor wall. The mounting plate has a mounting face for facing the rotor wall to which it is to be mounted and a wear face for facing the interior of the rotor. The wear face is provided with at least one material retention hole for retaining, at the wear face, at least one of a wear-resistant insert and material to be crushed.

14 Claims, 9 Drawing Sheets

WEAR TIP HOLDER FOR A VSI CRUSHER, A KIT COMPRISING A WEAR TIP HOLDER, AND A METHOD OF REDUCING THE WEAR RATE OF A WEAR TIP HOLDER

RELATED APPLICATION DATA

This application is a §371 National Stage Application of PCT International Application No. PCT/EP2012/066753 filed Aug. 29, 2012 claiming priority of EP Application No. 11182571.7, filed Sep. 23, 2011.

FIELD OF THE INVENTION

The present invention relates to a wear tip holder for holding a wear tip adjacent to an outflow opening of a vertical rotor wall of a rotor of a VSI crusher. The invention also relates to a kit comprising such a wear tip holder, and to a method of reducing the wear rate of a wear tip holder.

BACKGROUND OF THE INVENTION

Vertical shaft impact crushers (VSI crushers) are used in many applications for crushing hard material, such as rocks, ore etc. A VSI crusher comprises a housing and a horizontal rotor located inside the housing. WO 2008133568 (A1) discloses an example of a rotor of a VSI crusher. Material that is to be crushed is vertically fed into the rotor, and with the aid of centrifugal force the rotating rotor ejects the material against the inner wall of the housing. On impact with the wall of the housing the material is crushed to a desired size. The housing wall could be provided with anvils or have a bed of retained material against which the accelerated material is crushed.

The rotor of a VSI crusher usually has a horizontal upper disc and a horizontal lower disc. The upper disc has an aperture for feeding material to be crushed into the rotor, such that the material lands on the lower disc. The upper and lower discs are interconnected by a vertical rotor wall, which guides the material to material outflow openings about the circumference of the rotor. The vertical rotor wall of WO 2008133568 is provided with a number of wear tips adjacent to the outflow openings in the rotor wall, to protect the rotor wall from wear caused by the material leaving the rotor at a high speed. The wear tips are provided with air flow directing ridges for reducing the wear of the wear tips and the rotor wall.

When the wear tips have become worn out they must be replaced. Replacement of the wear parts requires the VSI crusher to be shut down for a considerable time for maintenance.

SUMMARY OF THE INVENTION

It is an object of the present invention to solve, or at least mitigate, parts or all of the above mentioned problems. To this end, there is provided a wear tip holder for holding a wear tip adjacent to an outflow opening of a vertical rotor wall of a rotor of a VSI crusher, said wear tip holder comprising a mounting plate for mounting the wear tip holder to said rotor wall, the mounting plate having a mounting face for facing the rotor wall to which it is to be mounted and a wear face for facing the interior of the rotor, the wear face being provided with at least one material retention hole for retaining, at the wear face, at least one of a wear-resistant insert and material to be crushed. When such a wear tip holder is used in a VSI crusher, material to be crushed may become firmly trapped in, and protrude from, the at least one material retention hole.

Alternatively, a wear-resistant insert may have been located in the hole already before starting the crusher. The trapped material/wear-resistant insert will act as a wear surface, sparing the wear face of the wear tip holding plate. The trapped material/wear-resistant insert will also significantly increase the friction of the wear face, thereby assisting in forming and maintaining a bed of material on the rotor wall as well as on the wear tip holder. Thereby, the wear of the rotor wall as well as of the wear tip and wear tip holder will be reduced, such that an increase of the service interval of the crusher may be allowed. Throughout this disclosure, the term "wear-resistant" is to be construed as comprising a material having a higher resistance to wear than the wear face of the mounting plate.

According to an embodiment, said at least one material retention hole covers at least 10% of the area of the wear face. By covering a relatively significant portion of the wear face, a significant increase of the mounting plate wear face friction may be obtained, thereby improving the material bed maintaining ability of the wear tip holder. This even further reduces the wear of the mounting plate's wear face.

According to an embodiment, said material retention hole is a through-hole penetrating the mounting plate from the wear face to the mounting face.

According to an embodiment, at least a portion of the periphery of said at least one material retention hole is chamfered so as to form a retention surface facing the rotor wall to which the wear tip holder is to be mounted. Thereby, when in use, material to be crushed is wedged between the retention surface and the surface of the rotor wall facing the mounting surface of the mounting plate. Alternatively, when used together with a wear-resistant insert, the insert may be held in the material retention hole without the use of glue or other separate fastening means. Furthermore, should the insert crack into multiple pieces, e.g. due to the impact of a piece of rock to be crushed, the pieces may still be held in place by the retention surface.

According to an embodiment, said at least one material retention hole tapers in a direction from the mounting face towards the wear face. Such a design even more firmly wedges material to be crushed, or the wear-resistant insert as the case may be, in the material retention hole. In particular, any cracked insert will be held even more firmly in place by the tapering shape of the material retention hole.

According to an embodiment, said at least one material retention hole is essentially oval. Material retention holes of such a design have proven to be efficient in retaining material, while still being relatively practical to fabricate.

According to an embodiment, said at least one material retention hole is located at the vertical centre of the mounting plate. Such a design is particularly well suited for a wear tip holder configured for mounting to the rotor wall using a pair of threaded bars extending in the plane of the mounting plate, since the pair of threaded bars may, without compromising the integrity or wear resistance of the material retention hole, be screwed into the mounting plate on either side of the at least one material retention hole. Furthermore, the need for wear resistance has been found to be the highest near the vertical centre of the mounting plate.

According to an embodiment, said at least one material retention hole comprises a pair of material retention holes, said pair of material retention holes being vertically separated and located on either side of the vertical centre of the mounting plate. Such a design is particularly well suited for a wear tip holder configured for mounting to the rotor wall using a single threaded bar extending in the plane of the mounting plate, since the threaded bar may be screwed into the mounting plate at the vertical centre of the mounting plate.

According to another aspect of the invention, parts or all of the above mentioned problems are solved, or at least mitigated, by a wear tip holder kit comprising a wear tip holder according to what has been described above and at least one wear-resistant insert, said at least one wear-resistant insert fitting into said at least one material retention hole and comprising a material having a higher resistance to wear than the wear face of the mounting plate. The insert may be fixed in the hole, e.g. by gluing, or may be adapted to be removably inserted in the hole. Such a kit is of particular value when there is a need for increased wear resistance of the mounting plate, e.g. when processing highly abrasive industrial mineral.

According to an embodiment, said at least one wear-resistant insert comprises a ceramic material. According to an embodiment, said ceramic material comprises aluminium oxide.

According to an embodiment, said at least one wear-resistant insert is shaped so as to, when in use, be flush with or protrude from the wear face of the mounting plate. Such a design is particularly useful when very fine material, i.e. material having an average diameter of less than 10 mm, is to be crushed.

According to an embodiment, said at least one wear-resistant insert has a tapering shape, for form-fittingly engaging with a corresponding shape, tapering in a direction from the mounting face towards the wear face, of said at least one material retention hole. Thereby, should the insert crack into multiple pieces, e.g. due to the impact of a piece of rock to be crushed, the pieces may still be held in place by the tapering shape of the material retention hole.

According to yet another aspect of the invention, parts or all of the above mentioned problems are solved, or at least mitigated, by a method of decreasing the wear rate of a wear tip holder of a VSI crusher, the method comprising trapping at least one of a wear-resistant insert, and material to be crushed, in at least one material retention hole provided in a wear face of a wear tip holder mounting plate. Thereby, the wear-resistant insert and/or trapped material to be crushed will at least partly protect the mounting plate from wear.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION OF THE EXEMPLARY EMBODIMENTS

Figure 1:
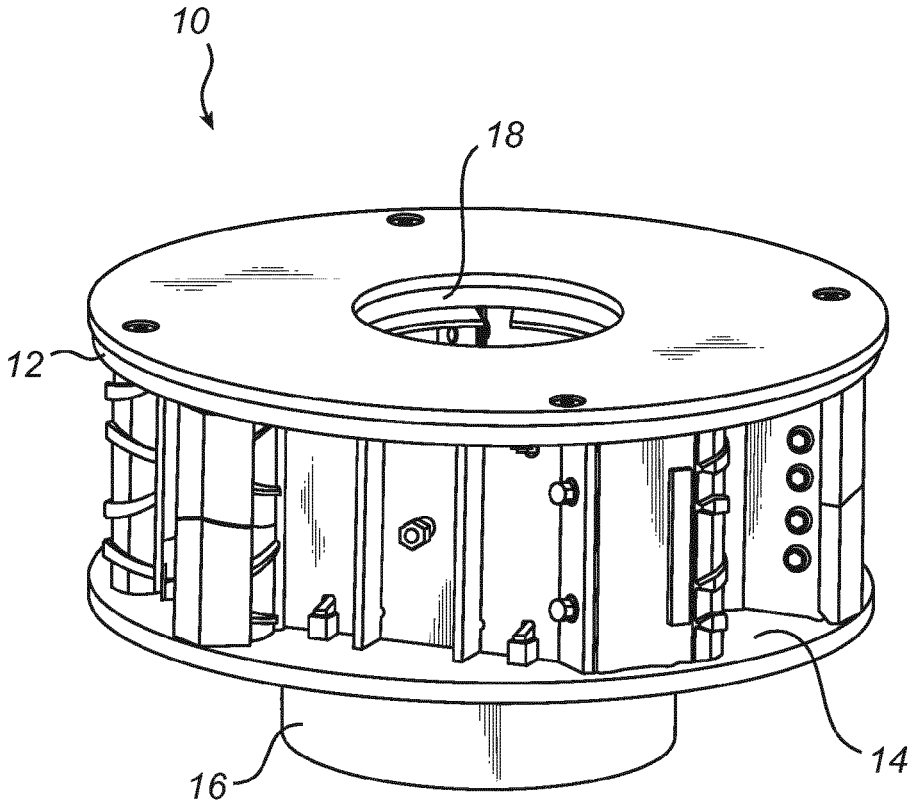
FIG. 1 is a three-dimensional view and shows a rotor for a VSI crusher.

FIG. 1 shows a rotor 10 for use in a Vertical Shaft Impact Crusher, i.e., a VSI crusher. The rotor 10 has a roof in the form of a horizontal upper disc 12, and a floor in the form of a horizontal lower disc 14. The lower disc 14 has a hub 16, which is welded to the disc 14. The hub 16 is to be connected to a shaft (not shown) for rotating the rotor 10 inside the housing of a VSI crusher. The upper disc 12 has a central aperture 18 through which material to be crushed can be fed into the rotor 10.

Figure 2:
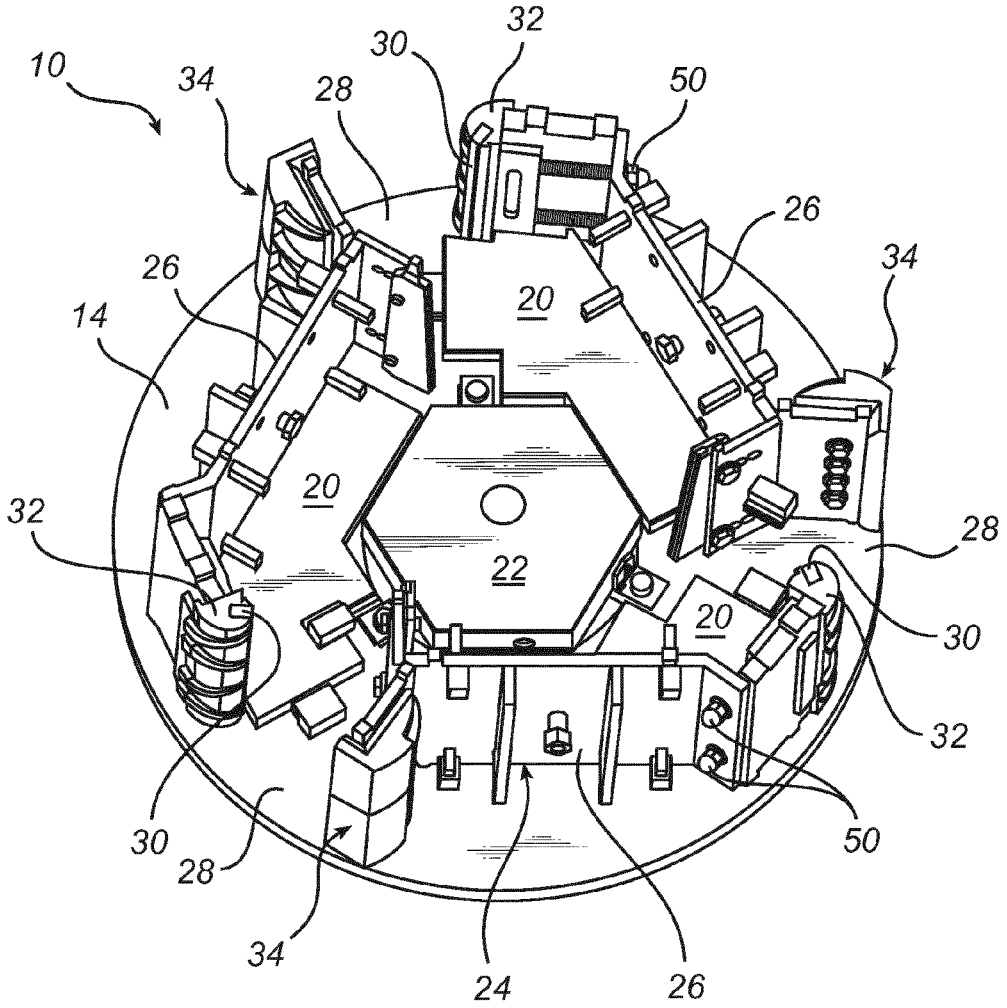
FIG. 2 is a three-dimensional view and shows the rotor of FIG. 1 with the upper disc removed.

As is shown in FIG. 2 the lower disc 14 is protected from wear by lower wear plates 20. A distributor plate 22 is fastened to the centre of the lower disc 14. The distributor plate 22 distributes the material that is fed via the aperture 18 in the upper disc 12 (FIG. 1).

The upper and lower discs 12, 14 are separated by and held together by a vertical rotor wall 24, which is separated into three separate wall segments 26. Gaps between the wall segments 26 define outflow openings 28, through which material may be ejected against a housing wall (not shown). At each outflow opening 28 the respective wall segment 26 is protected from wear by a wear tip 30 located at the leading edge of the respective wall segment 26. Each wear tip 30 is mounted to the respective wall segment 26 by means of a wear tip holder 32, which will be described further below. Each wall segment 26 is also provided with a respective pair 34 of cavity wear plates, which protect the rotor 10 and in particular the wear tips 30 from material rebounding from the housing wall and from ejected material and airborne fine dust spinning around the rotor 10.

Figure 3:
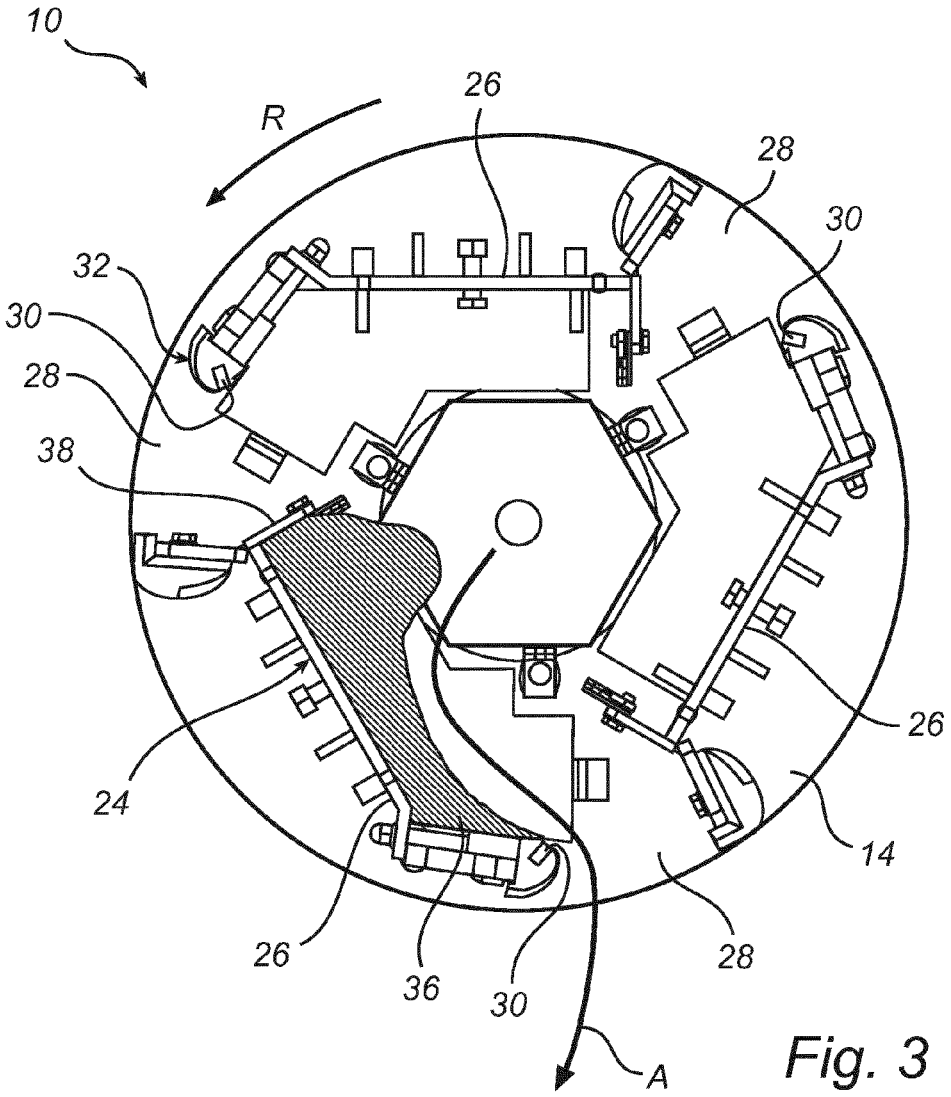
FIG. 3 shows the view of FIG. 2 as seen from above in a two dimensional perspective.

FIG. 3 illustrates the rotor 10 as seen from above and in operation. The upper disc 12 is not shown in FIG. 3 for reasons of clarity. The arrow R indicates the rotational direction of the rotor 10 during operation of the VSI crusher. During operation of the rotor 10 a bed 36 of material is built up inside the rotor 10 against each of the three wall segments 26. In FIG. 3 only the bed 36 located adjacent to one of the wall segments 26 is shown. The bed 36, which consists of material that has been fed to the rotor 10 and then has been trapped inside it, extends from a rear support plate 38 to the wear tip 30. The bed 36 protects the wall segment 26 and the wear tip 30 from wear and provides a proper direction to the ejected material. The bed 36 of material forms an autogenous wear surface, which is regenerated as more material is fed into the crusher. The arrow A describes a typical passage of a piece of rock fed to the rotor 10 via the central aperture 18 and ejected via the outflow opening 28.

Figure 4A:
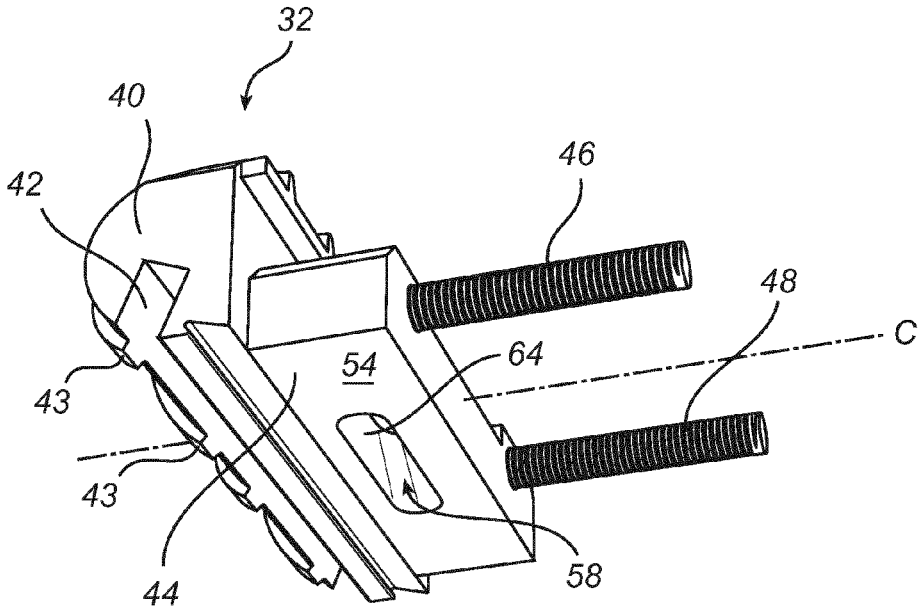
FIG. 4*a* is a three-dimensional view of a wear tip holder according to a first embodiment.
Figure 4B:
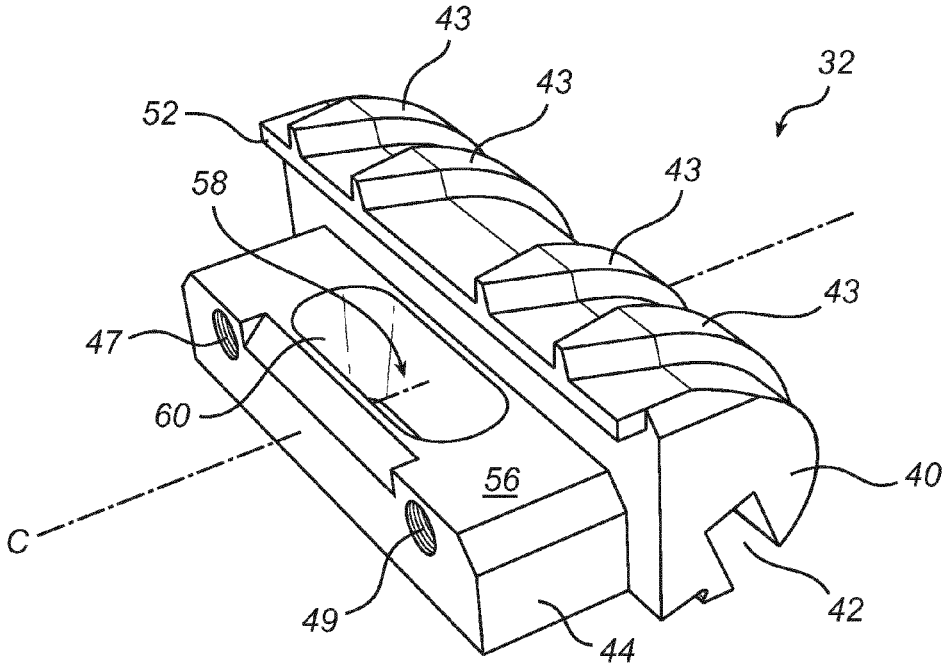
FIG. 4*b* is a further three-dimensional view of the wear tip holder of FIG. 4*a;*

FIGS. 4*a* and 4*b* illustrate a first embodiment of a wear tip holder 32. The wear tip holder 32 has a wear body 40 with an elongate recess 42, in which the wear tip 30 (FIG. 2) is to be located. The wear tip 30, which typically comprises a hard material such as tungsten carbide, may, by way of example, be welded or glued to the wear body 40. Ridges 43 extend across the wear body 40, and serve for forming an irregular turbulent air flow adjacent to the wear tip 30 in the manner described in greater detail in WO 2008/133568, such that the abrasive effect of dust laden air flowing past the wear tip 30 will be minimized.

The recess 42 and wear tip 30 extend, when the wear tip holder 32 is mounted to a horizontal rotor 10 (FIGS. 1-3), in a vertical direction along the wear body 40. The vertical centre of the wear tip holder 32, when in use, is illustrated by a dashed line C.

A mounting plate 44, which is a flat, rectangular plate for mounting the wear tip holder 32 to a vertical wall segment 26 of the rotor 10, is attached to the wear body 40. Two threaded bars 46, 48 extend from one end of the mounting plate 44. By means of these two bars 46, 48 the wear tip holder 32 can be mounted to the wall segment 26 and fixed by nuts 50 (FIG. 2). A holding flange 52, extending from the wear body 40 at a distance from and in the same general direction as the mounting plate 44, serves for gripping and holding the wall segment 26 in a manner which will be illustrated in greater detail in FIG. 5. Referring again to FIGS. 4*a-b*, the mounting plate has a wear face 54 (FIG. 4*a*), which, when the wear tip holder 32 is attached to the rotor wall 24, faces the interior of the rotor 10, and which is exposed to wear at any location where it is not protected by the bed 36 of material (FIG. 3). The mounting plate 44 also has a mounting face 56 (FIG. 4*b*), which abuts the surface of the wall segment 26 when the wear tip holder 32 is attached to the wall 24.

A material retention hole 58 penetrates the mounting plate 44 from the wear face 54 to the mounting face 56. The material retention hole 58 has an elongate shape extending in the vertical direction of the mounting plate 44. In the embodiment of FIGS. 4*a-b*, the material retention hole 58 essentially has the shape of an oval, or of a rectangle with curved short sides. Furthermore, the material retention hole 58 tapers in a direction from the mounting face 56 towards the wear face 54, such that material retention hole's 58 aperture 60 in the mounting face 56 is larger than its aperture 64 in the wear face 54.

Figure 5:
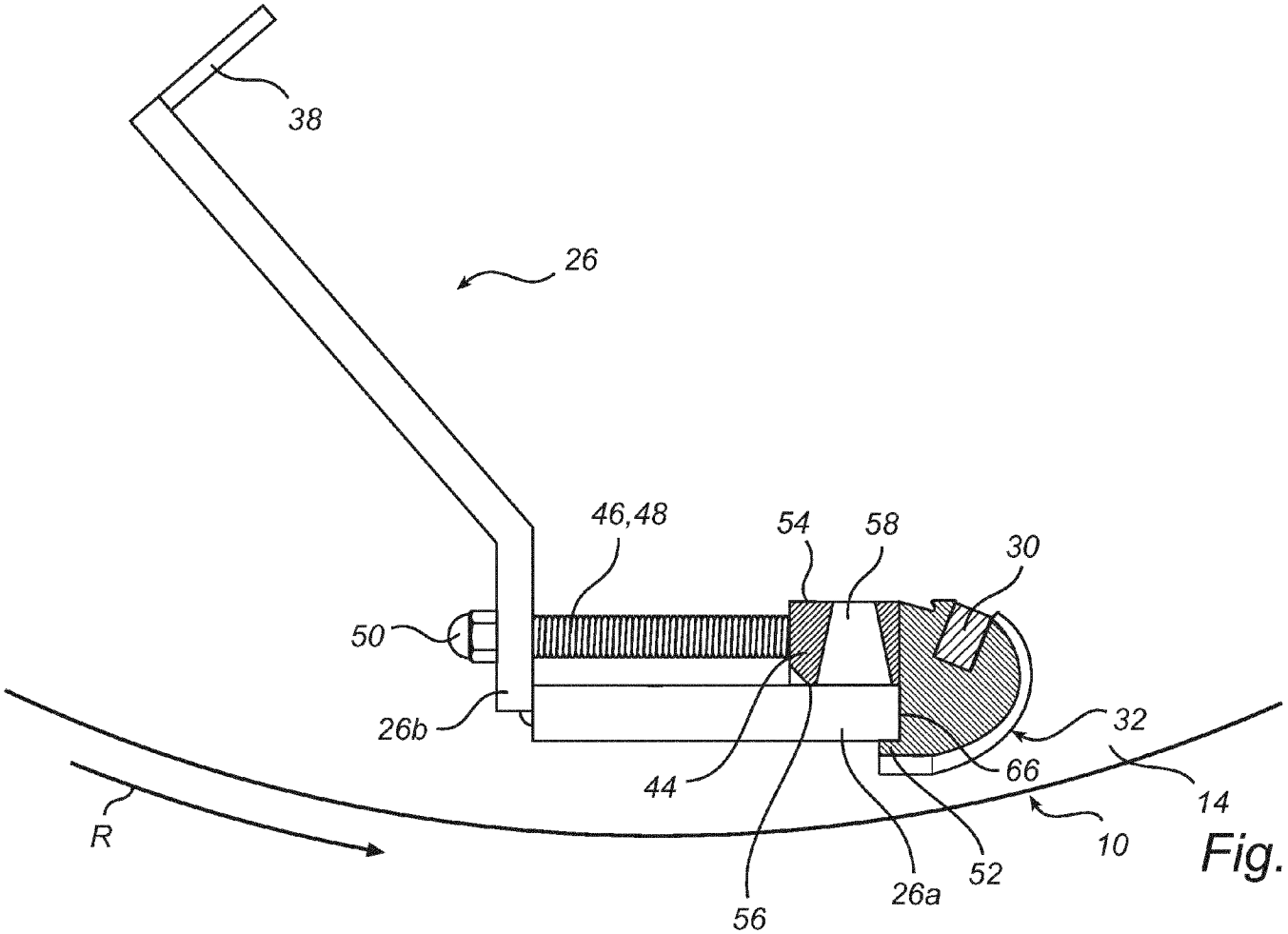
FIG. 5 is a diagrammatic view in section, as seen from above, of a detail of the rotor of FIG. 3.

The top view of FIG. 5 illustrates how the wear tip holder 32, when in use, is mounted to a rotor wall segment 26. The mounting face 56 of the mounting plate 44 rests on, and abuts, a first portion 26*a* of the wall segment 26 in such a manner that the holding flange 52 of the wear tip holder 32 grips an edge 66 of the wall segment 26. The threaded bars 46, 48 penetrate a second portion 26*b* of the wall segment, and nuts 50 are tightened on the threaded bars 46, 48 such that the holding flange 52 firmly grips the wall segment 26.

The material retention hole 58 clearly illustrated in cross-section tapers from the mounting face 56 to the wear face 54. When the wear tip holder 32 is mounted to the rotor 10, the first portion 26*a* of the rotor wall segment 26 forms a bottom of the material retention hole 58, such that the material retention hole 58 opens only towards the wear face 54.

Figure 6:
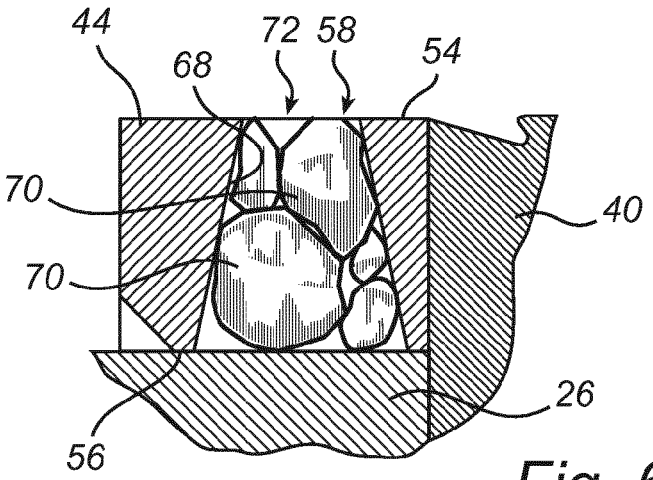
FIG. 6 is a diagrammatic view in section, as seen from above, of a wear tip mounting plate mounted onto a rotor wall segment.

FIG. 6 illustrates the function of the material retention hole 58 when material to be crushed is present in the rotor 10. Due to the tapering shape of the material retention hole 58, the inclined inner wall of the hole 58 forms a material retention surface 68 obliquely facing the rotor wall segment 26.

Even though not illustrated, it will be appreciated that there will be, on the wear face 54 of the mounting plate 44, a bed 36 of material to be crushed. Pieces 70 of material to be crushed, e.g. pieces of rock, have, by operating the crusher, been trapped in the material retention hole 58 and wedged between the retention surface 68 and the rotor wall segment 26. The pieces 70 of material form a rough, structured surface 72 facing the interior of the rotor 10, thereby assisting in preventing the bed 36 of material (FIG. 3) from sliding across the wear tip 30 and leaving the rotor 10. Furthermore, the adjacency of the surface 72 to the wear tip 30 assists in extending the bed 36 of material very close to the wear tip 30, thereby protecting the wear tip 30 from wear.

Figure 7A:
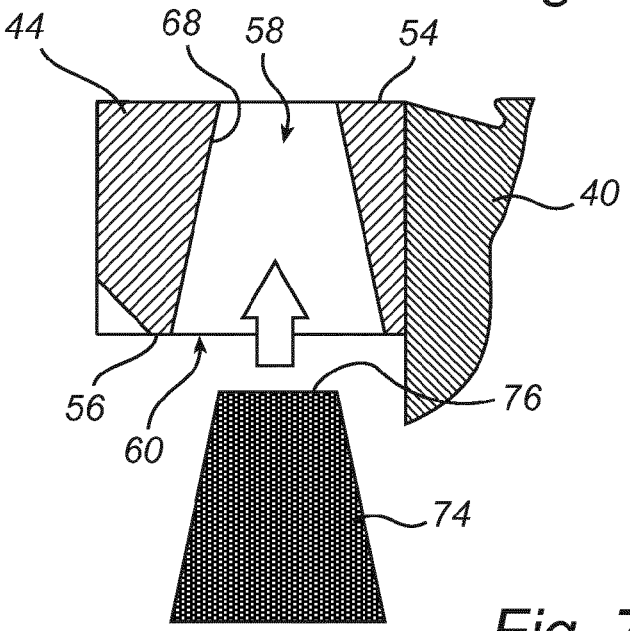
FIG. 7*a* is a diagrammatic view in section, as seen from above, of a wear tip mounting plate in the process of being provided with a wear-resistant insert.
Figure 7B:
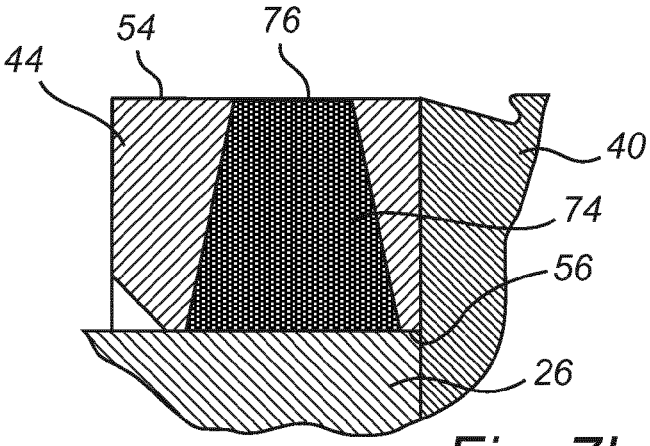
FIG. 7*b* is a diagrammatic view in section, as seen from above, of the wear tip mounting plate of FIG. 7*a* as provided with a wear-resistant insert and mounted onto a rotor wall segment.

FIGS. 7*a-b* illustrate an alternative use of the material retention hole 58. Before mounting the wear tip holder 32 (FIG. 5) to the rotor wall segment 26, a wear-resistant insert 74 is inserted into the material retention hole 58 via the aperture 60 of the mounting face 56. The wear-resistant insert 74 has a tapering shape so as to fit snugly into the material retention hole 58. Then, as is illustrated by FIG. 7*b*, the wear tip holder 32 is mounted to the rotor wall segment 26, such that the insert 74 is trapped between the retention surface 68 and the wall segment 26.

The wear-resistant insert 74 comprises a material having a higher resistance to wear than the material of the mounting plate 44 surrounding the insert 74. Thereby, the insert 74 will operate so as to decrease the wear rate of the wear face 54. The insert may also have a surface 76 that is rougher than the wear face 54 of the mounting plate 44, such that the combined friction of the wear face 54 of the mounting plate 44 and the surface 76 of the insert 74 will be higher than would have been the friction of a wear face 54 having no insert 74. Thereby, the insert will assist in maintaining a bed 30 of material (FIG. 3) on the wall segment 26.

The insert 74 may, by way of example, have a ceramic surface 76 comprising e.g. aluminium oxide. In fact, the entire insert may be a ceramic insert. The insert may also comprise any other suitable wear-resistant material, such as tungsten carbide, white iron or the like.

A wear-resistant insert 74 may be of particular value for sparing the mounting plate 44 when processing highly abrasive industrial minerals. Moreover, the risk of worn-off metal causing problems in any downstream industrial process will be reduced. The wear-resistant insert 74 may be inserted and removed as needed, e.g. when changing the composition or properties of the material to be crushed. By way of example, it has been found that the wear-resistant insert 74 may provide a better wear resistance of the wear tip 30 and wear tip holder 32 when processing wet, fine material, e.g. material having a mean diameter of less than about 10 mm. When processing dry material or material having a mean diameter of more than about 10 mm, the use of the material retention hole 58 without a wear-resistant insert 74 may provide the best wear resistance. Clearly, the material trapping efficiency of the material retention hole 58, as well as the friction of the surface 76 of the wear-resistant insert 74, depend on the properties of the material to be crushed.

FIGS. 8-12 illustrate exemplary alternative embodiments of material retention holes 158, 258, 358, 458, 558. Each of the holes 158, 258, 358, 458, 558 may be used for retaining an autogenous wear layer of material to be crushed, as has been described hereinbefore with reference to FIG. 6, or for retaining a wear-resistant insert as has been described with reference to FIGS. 7*a-b*.

Figure 8:
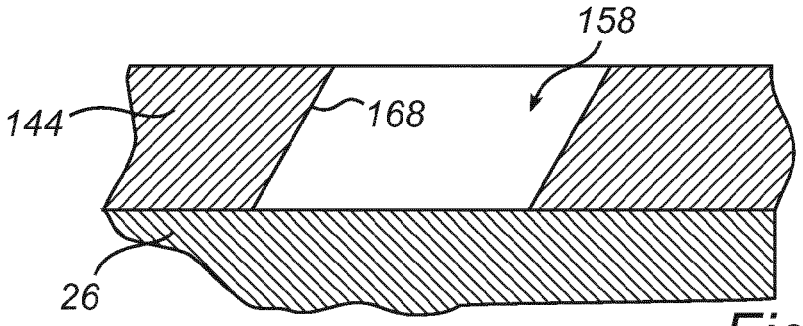
FIG. 8 is a diagrammatic view in section, as seen from above, of a detail of a wear tip mounting plate according to a second embodiment, mounted onto a rotor wall segment.

FIG. 8 illustrates a cross-section of a portion of a mounting plate 144 provided with a material retention hole 158, wherein only a portion of the inner wall of the hole 158 is chamfered so as to form a material retention surface 168 facing the wall segment 26.

Figure 9:
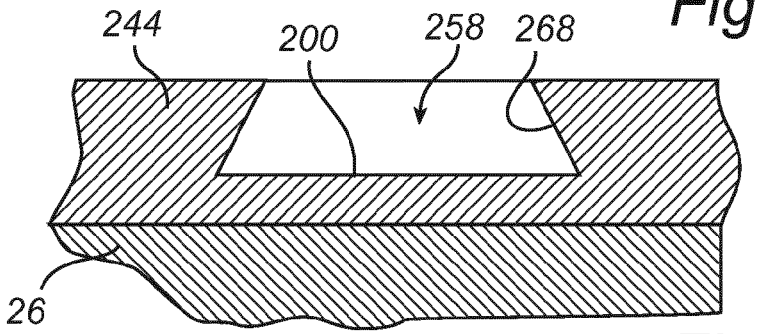
FIG. 9 is a diagrammatic view in section, as seen from above, of a detail of a wear tip mounting plate according to a third embodiment, mounted onto a rotor wall segment.

FIG. 9 illustrates a cross-section of a portion of a mounting plate 244 provided with a material retention hole 258, wherein the material retention hole 258 is provided with a bottom 200 formed in the mounting plate 244. Even though the bottom 200 combined with a sloping material retention surface 268 may make it difficult to insert a single, solid and snugly fitting wear-resistant insert, a wear-resistant insert may still be inserted, e.g. by assembling it inside the hole from multiple pieces or by curing a liquid insert inside the hole 158.

Figure 10:
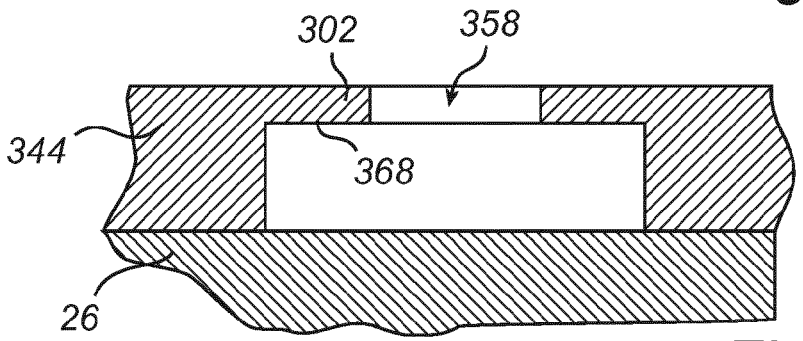
FIG. 10 is a diagrammatic view in section, as seen from above, of a detail of a wear tip mounting plate according to a fourth embodiment, mounted onto a rotor wall segment.

FIG. 10 illustrates a cross-section of a portion of a mounting plate 344 provided with a material retention hole 358, wherein a portion of the periphery of the material retention hole 358 is chamfered so as to form a circumferential flange 302 having a retention surface 368 facing the rotor wall segment 26.

Figure 11:
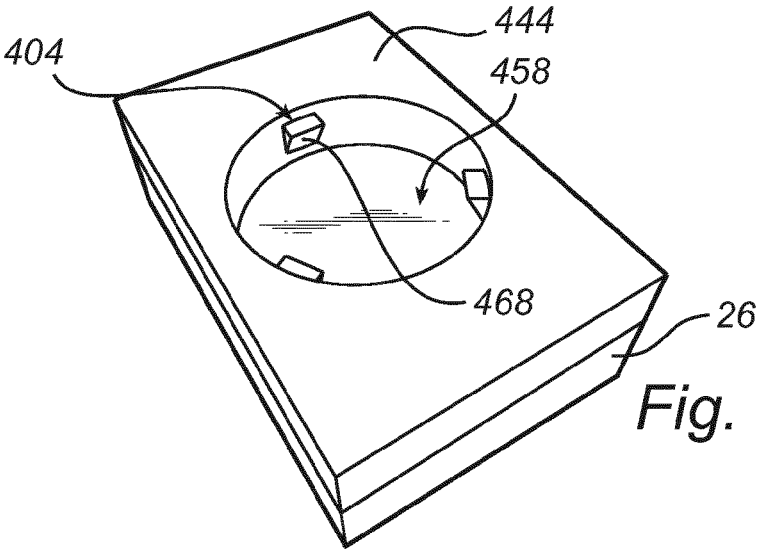
FIG. 11 is a schematic view in perspective of a detail of a wear tip mounting plate, according to a fifth embodiment, mounted onto a rotor wall segment.

FIG. 11 illustrates a cross-section of a portion of a mounting plate 444 provided with a material retention hole 458. The material retention hole 458 is provided with a plurality of inwardly projecting material retention dogs 404, each material retention dog 404 being chamfered to form a material retention surface 468 facing the rotor wall segment 26.

Figure 12:
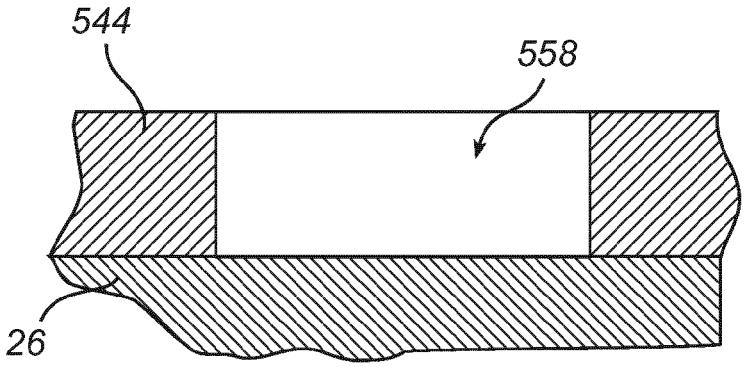
FIG. 12 is a diagrammatic view in section, as seen from above, of a detail of a wear tip mounting plate according to a sixth embodiment, mounted onto a rotor wall segment.

FIG. 12 illustrates a material retention hole 558 with straight edges and having no material retention surface facing the rotor wall segment 26. Material to be crushed may still be trapped in the material retention hole 558, so as to form an autogenous wear layer protecting the mounting plate 544.

Figure 13A:
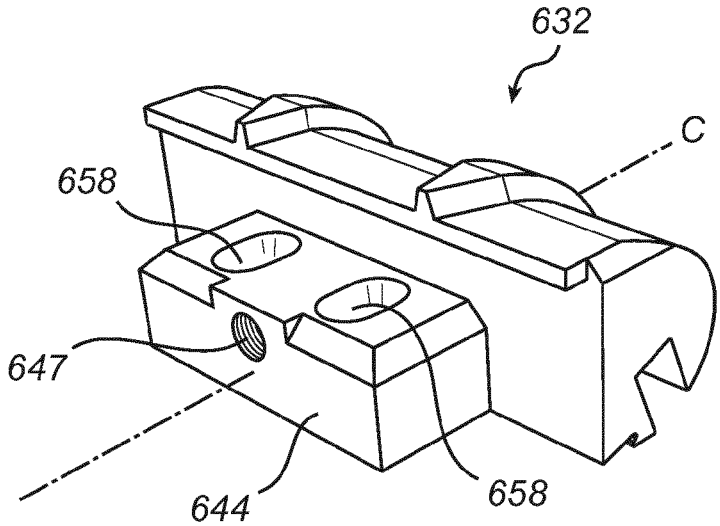
FIG. 13*a* is a three-dimensional view of a wear tip holder according to a seventh embodiment.

FIG. 13*a* illustrates a wear tip holder 632 for use in an aggregate wear tip holder assembly. The wear tip holder 632 has a mounting plate 644 provided with a single threaded hole 647 for receiving a threaded bar (not shown). The threaded hole 647 is located at the vertical centre C of the wear tip holder 632. A pair of material retention holes 658 are located on either side of the threaded hole 647.

Figure 13B:
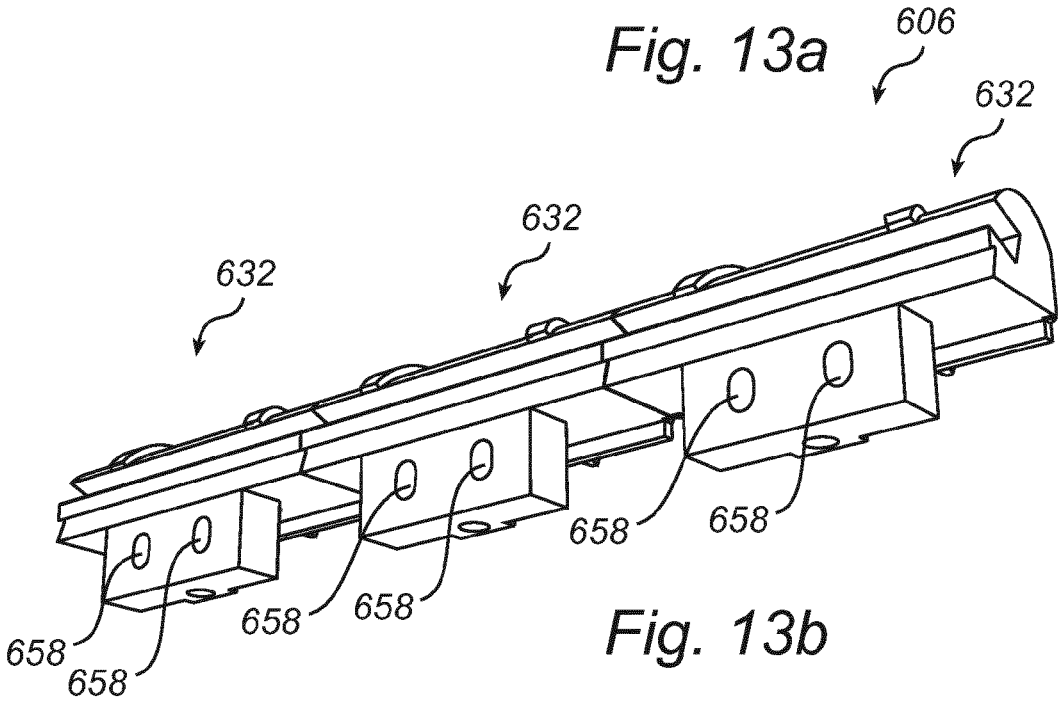
FIG. 13*b* is a three-dimensional view of an aggregate wear tip holder comprising three wear tip holders of the type illustrated in FIG. 13*a;*

FIG. 13*b* illustrates an aggregate wear tip holder assembly 606 comprising three wear tip holders 632. Each of the wear tip holders 632 comprises a pair of material retention holes 658.

Figure 14:
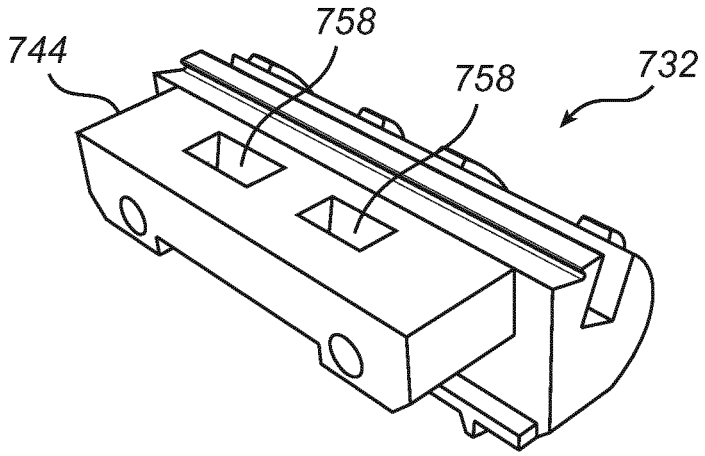
FIG. 14 is a three-dimensional view of a wear tip holder according to an eighth embodiment.
Figure 15:
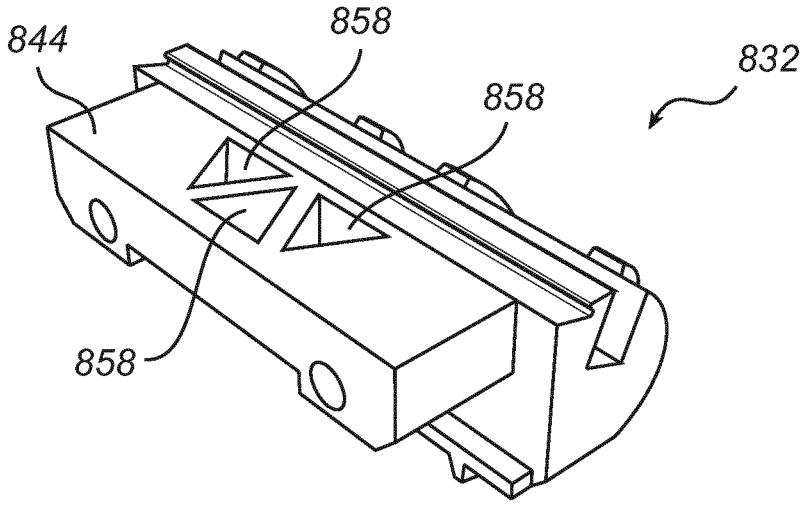
FIG. 15 is a three-dimensional view of a wear tip holder according to a ninth embodiment.

Clearly, it is not necessary that a material retention hole be oval. FIG. 14 illustrates a wear tip holder 732 having a mounting plate 744 provided with two rectangular material retention holes 758, whereas FIG. 15 illustrates a wear tip holder 832 having a mounting plate 844 provided with three material retention holes 858.

The invention has mainly been described above with reference to a few embodiments. However, as is readily appreciated by a person skilled in the art, other embodiments than the ones disclosed above are equally possible within the scope of the invention, as defined by the appended patent claims.

For example, the invention is not limited to any particular number of material retention holes in a single wear tip holder mounting plate. Moreover, the invention is not limited to any particular size or shape of the material retention hole(s), since many different hole sizes and hole shapes are suitable for holding, when the wear tip holder is in use, either a wear-resistant insert or material to be crushed. All such embodiments fall within the scope of the appended claims.

The invention claimed is:

1. A wear tip holder for holding a wear tip adjacent to an outflow opening of a vertical rotor wall of a rotor of a VSI crusher, said wear tip holder comprising:

a wear body having a recess for receiving the wear tip; and a mounting plate attached to the wear body for mounting the wear tip holder to said rotor wall, the mounting plate having a mounting face facing the rotor wall to which it is to be mounted and a wear face facing the interior of the rotor, wherein the mounting plate includes at least one material retention hole penetrating the mounting plate from the wear face to the mounting face for retaining, at the wear face, at least one of a wear-resistant insert and material to be crushed disposed in the at least one material retention hole.

2. The wear tip holder according to claim 1, wherein said at least one material retention hole covers at least 10% of the area of the wear face.

3. The wear tip holder according to claim 1, wherein at least a portion of the periphery of said at least one material retention hole is chamfered so as to form a retention surface facing the rotor wall to which the wear tip holder is to be mounted.

4. The wear tip holder according to claim 1, wherein said at least one material retention hole tapers in a direction from the mounting face towards the wear face.

5. The wear tip holder according to claim 1, wherein said at least one material retention hole is oval.

6. The wear tip holder according to claim 1, wherein said at least one material retention hole is located at a vertical center of the mounting plate.

7. The wear tip holder according to claim 1, wherein said at least one material retention hole comprises two material retention holes, said material retention holes being vertically separated and located on either side of a vertical center of the mounting plate.

8. A wear tip holder kit comprising:

a wear tip holder for holding a wear tip adjacent to an outflow opening of a vertical rotor wall of a rotor of a VSI crusher, said wear tip holder including a wear body having a recess for receiving the wear tip, a mounting plate attached to the wear body for mounting the wear tip holder to the rotor wall, the mounting plate having a mounting face facing the rotor wall to which it is to be mounted and a wear face facing an interior of the rotor, wherein the mounting plate includes at least one material retention hole for retaining, at the wear face, at least one of a wear-resistant insert and material to be crushed; and at least one wear-resistant insert, said at least one wear-resistant insert fitting into said at least one material retention hole and comprising a material having a higher resistance to wear than the wear face of the mounting plate.

9. The wear tip holder kit according to claim 8, wherein said at least one wear-resistant insert comprises a ceramic material.

10. The wear tip holder kit according to claim 9, wherein said ceramic material comprises aluminium oxide.

11. The wear tip holder kit according to claim 8, wherein said at least one wear-resistant insert is shaped so as to, when in use, be flush with or protrude from the wear face of the mounting plate.

12. The wear tip holder kit according to claim 8, wherein said at least one wear-resistant insert has a tapered shape, for form-fittingly engaging with a corresponding shape, tapering in a direction from the mounting face towards the wear face, of said at least one material retention hole.

13. A method of decreasing the wear rate of a wear tip holder of a VSI crusher, comprising the steps of:

providing a wear tip holder, the wear tip holder including a wear body having a recess for receiving the wear tip and a mounting plate attached to the wear body for mounting the wear tip holder to a rotor wall of the crusher, the mounting plate having a mounting face for facing the rotor wall to which it is to be mounted and a wear face for facing the interior of the rotor, and at least one material retention hole penetrating the mounting plate, the at least one retention hole being a through-hole penetrating the mounting plate from the wear face to the mounting face; and trapping at least one of a wear-resistant insert and material to be crushed in the at least one material retention hole.

14. The wear tip holder of claim 1, wherein the at least one material retention hole opens only towards the wear face.

* * * * *